US008713785B2

(12) United States Patent
Gillam

(10) Patent No.: US 8,713,785 B2
(45) Date of Patent: May 6, 2014

(54) CUSTOM IMPRESSION CASE OR TRAY

(76) Inventor: Robert J. Gillam, Roselle, IL (US)

( * ) Notice: Subject to any disclaimer, the term of this patent is extended or adjusted under 35 U.S.C. 154(b) by 626 days.

(21) Appl. No.: 12/901,303

(22) Filed: Oct. 8, 2010

(65) Prior Publication Data

US 2011/0089072 A1 Apr. 21, 2011

Related U.S. Application Data

(60) Provisional application No. 61/252,467, filed on Oct. 16, 2009.

(51) Int. Cl.
*B23P 13/04* (2006.01)

(52) U.S. Cl.
USPC ..... 29/527.2

(58) Field of Classification Search
USPC ..... 29/527.2, 428, 458, 460; 206/523; 156/160; 264/129
See application file for complete search history.

(56) References Cited

U.S. PATENT DOCUMENTS 5,855,833 A * 1/1999 Stanley et al. ..... 264/129
6,990,744 B2 1/2006 Biegnaek
7,220,376 B2 5/2007 Hetzel et al.
7,262,862 B2 8/2007 Klaveness
7,373,678 B2 5/2008 Hetzel et al.

* cited by examiner

*Primary Examiner* — John C Hong
(74) *Attorney, Agent, or Firm* — Dillis V. Allen, Esq.

(57) ABSTRACT

A custom case for enclosing an item, and a method for making the same, are disclosed. The case includes an outer shell, and an inner base layer formed of an impression material such as impression foam. The impression foam can be used by compressing it with an item to be enclosed to produce a cavity. Thus, the cavity will be adapted to receive the item with a close fit. Preferably, the impression foam is then soaked with a glue such as a latex glue in order to cause it to be hardened. It may then be coated with a paint. A second layer may be added to the case also formed of impression foam to allow for a second item or set of items to be stored above the base layer. A method for making a custom case is also disclosed. The method includes the steps of providing an outer shell, providing the impression foam base layer, compressing the base layer, and preferably hardening the base layer using a glue. Optionally, the method also includes coating the base layer with a paint or stain. In other embodiments, the invention includes a customizable tray which can be adapted to fit items via impression material, and which can be adapted to fit within a drawer or other suitable place.

10 Claims, 6 Drawing Sheets

CUSTOM IMPRESSION CASE OR TRAY

CROSS-REFERENCE TO RELATED APPLICATIONS

This application claims the benefit of U.S. Provisional Application No. 61/252,467, filed Oct. 16, 2009, which is hereby incorporated by reference herein in its entirety.

BACKGROUND OF THE INVENTION

1. Field of the Invention

The present invention relates to a case or tray having a custom layout, and more particularly, to a case or tray having an impression foam layout and method for making the same.

2. Background

Various cases and trays for containing various items are known and used in multiple industries. For example, tool cases are known. Such tool cases sometimes include a foam or molded layer to hold the tools or items in place. However, these cases are typically permanently formed in the factory for a specific purpose.

To the extent that the user desires to create a customized case for a specific purpose, a factory made case is not suitable. Various options have been attempted. For example, a "pick and pluck" foam material has been used in order to enable a user to pluck out sections of foam to create holes for items. However, these materials do not allow for a close fit, as the foam is either present or not present in the hole, and thus, the cavity formed does not follow the contour of the item intended to be enclosed.

Furthermore, with such items, the foam layer is very flexible and may not hold items in place, and the surfaces are porous and subject to being ruined by dirt, grease, or moisture.

Various uses for impression foam have been made in other applications. For example, U.S. Pat. No. 6,990,744 issued to Bieganek et al., discloses a method for evaluating clearance from a contoured seat cushion. An impression foam material is used to evaluate how a person's body relates to a seat. However, the impression foam is merely used as a tool to evaluate pressure in various areas, and not used as a usable product.

In U.S. Pat. No. 7,220,376, issued to Hetzel et al., impression foam is again used to form a negative impression of a person's sitting profile. This information is used in producing a suitable wheel chair cushion, however, no final product is produced containing the impression foam.

U.S. Pat. No. 7,373,678, issued to Hetzel et al., discloses a seat cushion with an adjustable contour. An insert is used to change the contour of the surface of the cushion.

In U.S. Pat. No. 7,262,862, issued to Klaveness, a method is disclosed in which an object is pressed down into a membrane for the purpose of creating a three-dimensional scan of the object. However, no method of producing a suitable tray or case is disclosed.

Thus, there continues to be a need for a customizable case or tray which can be configured to hold user-selected items with a tight fit and suitable attributes.

SUMMARY

The present invention is a custom case for enclosing items. The case may be used as a tool case, or a case for storing or transporting any number of types of items. The case can be customized so that items can be enclosed with a close fit, and the user can create the customized layout to adapt it to receive user-selected items.

The case includes an outer shell. The outer shell is typically a hard case having a bottom and top portion hinged together. However, any number of outer shell configurations are contemplated. The outer shell may be formed of a hard plastic, or any other suitable material.

Inside the case is an inner base layer. The inner base layer is formed of an "impression material." By "impression material," it is meant that the material has the property that it can be compressed with an object, and the material holds the compressed shape after being compressed. Thus, the base layer can be customized by compressing it with objects such as those intended to be enclosed. The user can customize the case to hold whatever items the user desires. Since the items to be contained can be used to create the cavities in the base layer, the fit will be very close. The cavity created will be contoured to match the object.

The inner base layer may have a bottom surface formed to fit within the outer shell. It can have a snug fit. Optionally, the inner base layer may have an adhesive applied thereto in order to secure it to the bottom portion of the inside surface of the outer shell.

Preferably, the inner base layer is hardened. Impression materials such as impression foam may be very brittle or easily damaged. Thus, it is preferred that the material be hardened. One preferred method of hardening the material is by using a glue. For example, a latex glue may be used. The glue can be applied by submerging the impression material in the glue within a container, removing the impression material from the container, and allowing the glue to dry. Once dry, the hardened material will better hold its shape and resist damage.

In various embodiments, the hardened material can be coated with a paint or a stain. This can help create a non-porous surface, and can improve the aesthetics of the material. The paint can be brushed on, or applied in any suitable fashion. Any suitable paint can be used, such as a "truck bed paint" or any other paint which is compatible with this purpose.

As an alternative to the paint or stain coating, a process known as flocking can be used. In this process, the hardened material may be coated with an adhesive, and a felt material or felt-like material may be applied to the surface in order to provide a soft, cushioned surface. While this process can be used instead of the paint or stain coating, it may also be used on top of the paint or stain coating.

In various embodiments, a top layer of material is provided to hold items in place. The top layer may be a foam. Preferably, the foam has an eggshell configuration. This layer would fit within the lid of the outer shell. In certain alternate embodiments, this top layer can also be an impression foam and can be prepared in a manner similar to the base layer for a tighter fit.

In still other embodiments, a second base layer can be included in order to provide a second layer for enclosing additional items. The second layer can be prepared in the same manner as the inner base layer. The second layer is optionally placed directly above the first base layer for compact storage.

In further embodiments, a custom tray is provided. The tray is formed of impression material such as impression foam. Optionally, a hardening agent such as a latex glue is used to harden the tray. Furthermore, a coating of paint or stain can be used to produce a substantially non-porous surface and to enhance the aesthetics of the tray. Such a tray can be adapted to fit within a drawer, cabinet, or on a shelf, or to fit within or on any number of suitable places.

The custom tray of the present invention can be custom made by the user to include cavities with a shape impressed into the impression material to form a close fit with the items intended to be received. For example, a flatware tray could be produced by using flatware or similarly shaped objects to form the cavities. Alternatively, a jewelry tray, tool tray, or tray designed to hold any number of other specific objects can be formed.

Still other objects and advantages of the present invention will become readily apparent to those skilled in the art from the following detailed description, wherein it is shown and described only the preferred embodiments of the invention, simply by way of illustration of the best mode contemplated of carrying out the invention. As will be realized, the invention is capable of other and different embodiments and its several details are capable of modifications in various obvious respects, without departing from the invention. Accordingly, the drawings, wherein like reference numerals represent like features, and description are to be regarded as illustrative in nature and not as restrictive.

DETAILED DESCRIPTION OF THE INVENTION

Figure 1:
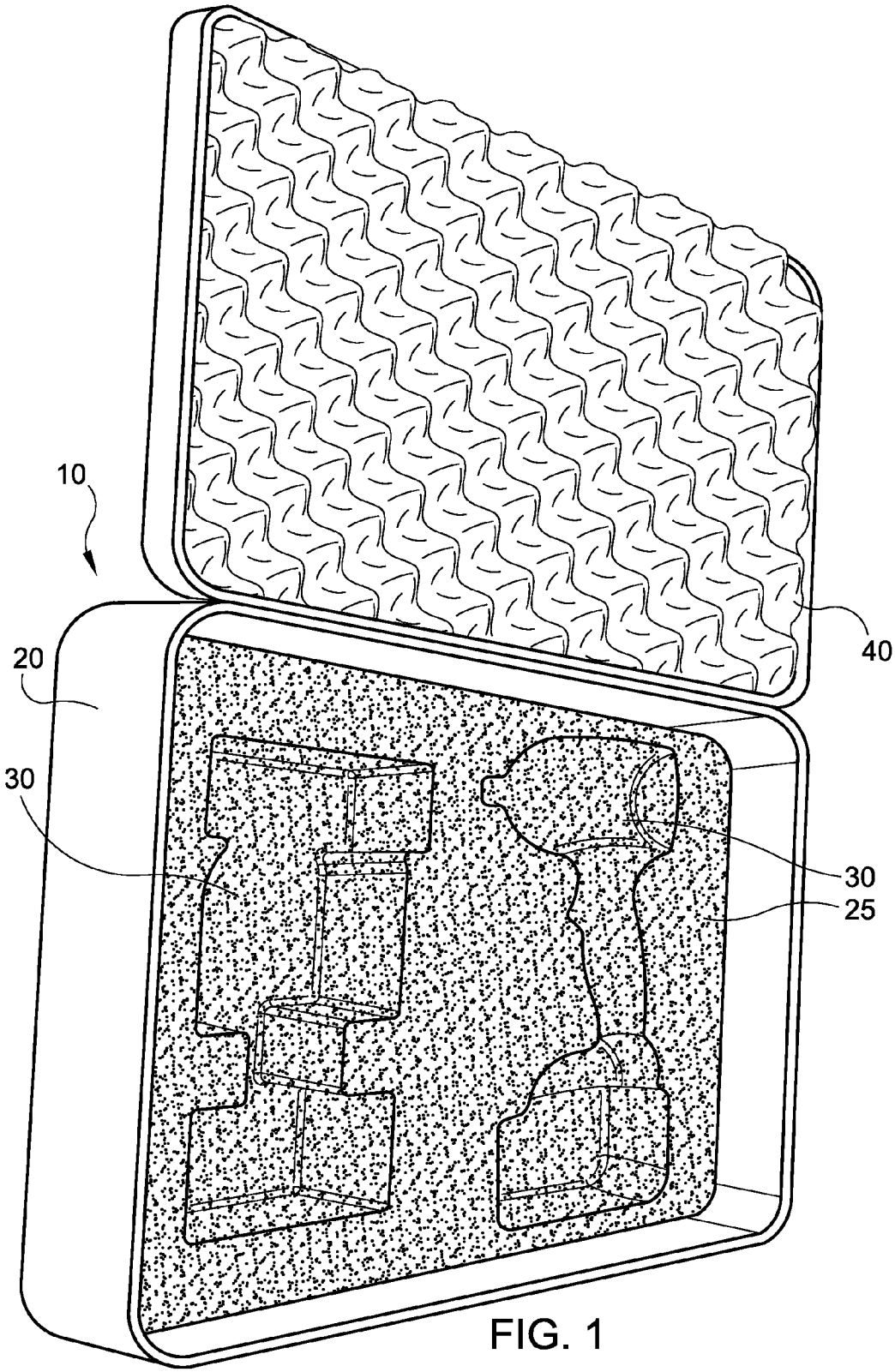
FIG. 1 shows a perspective view of one embodiment of the case of the present invention.
Figure 2:
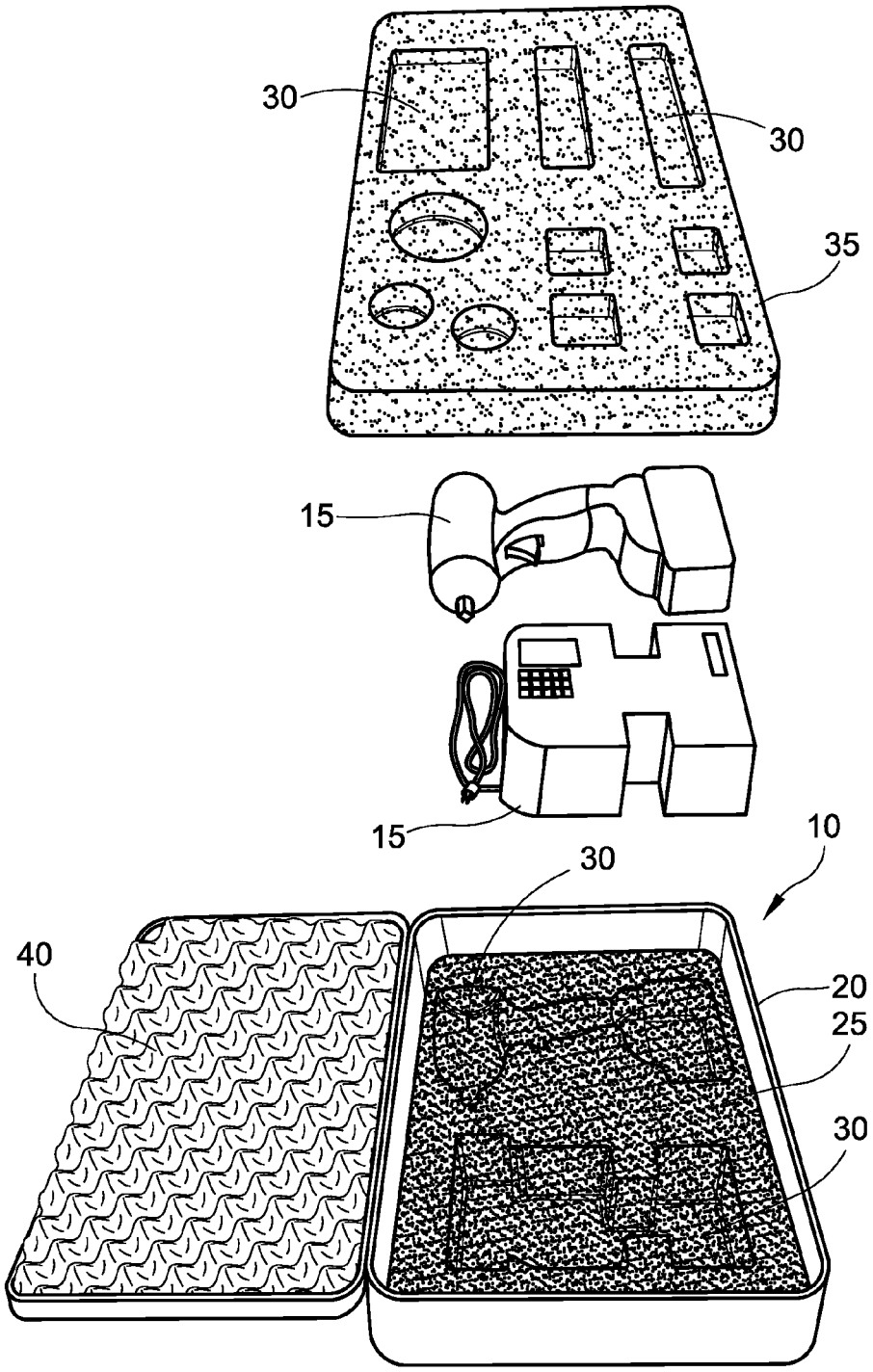
FIG. 2 shows a perspective view of another embodiment of the case of the present invention having a second layer.
Figure 3:
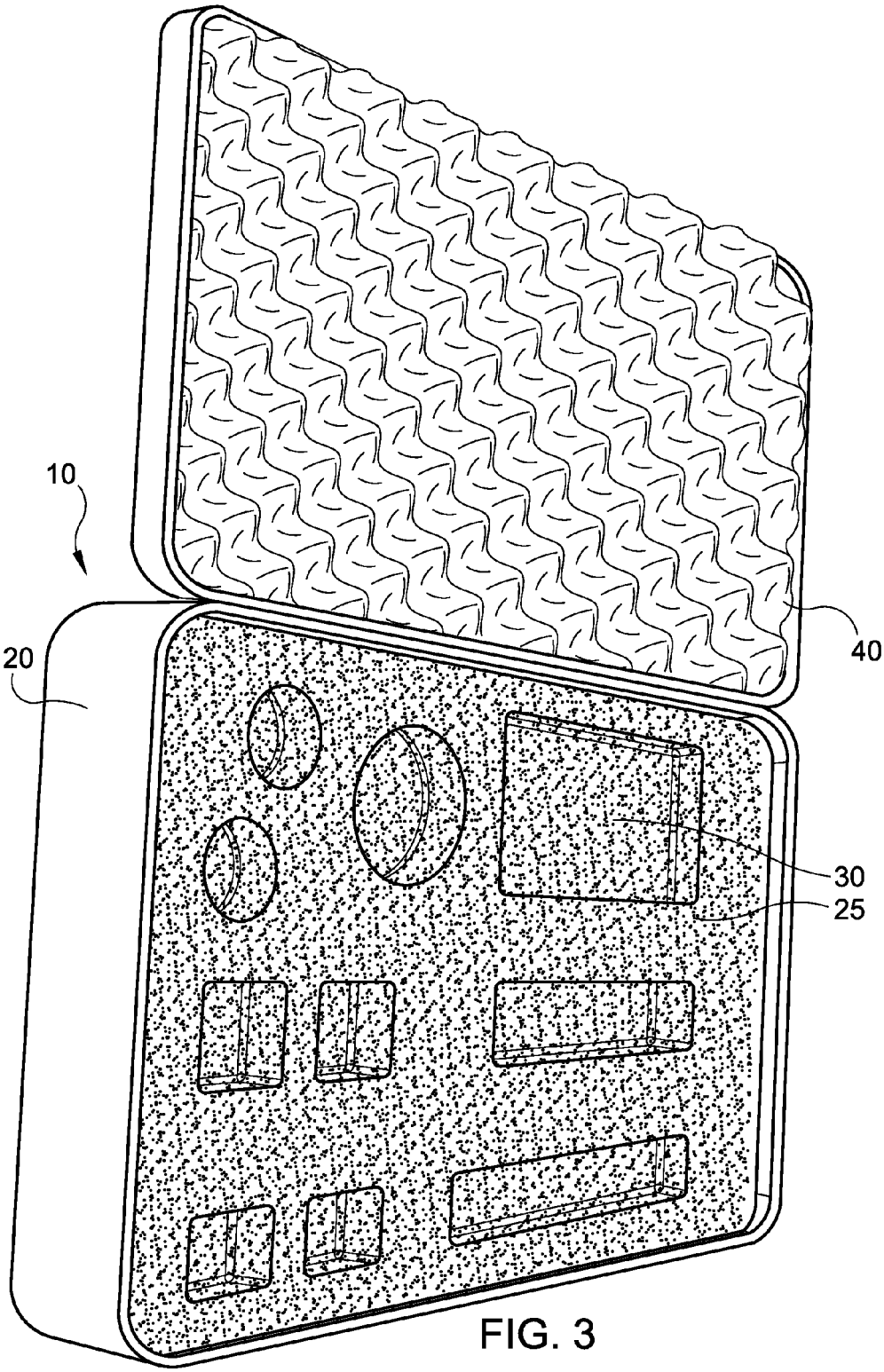
FIG. 3 shows a perspective view of one embodiment of the case of the present invention.
Figure 4:
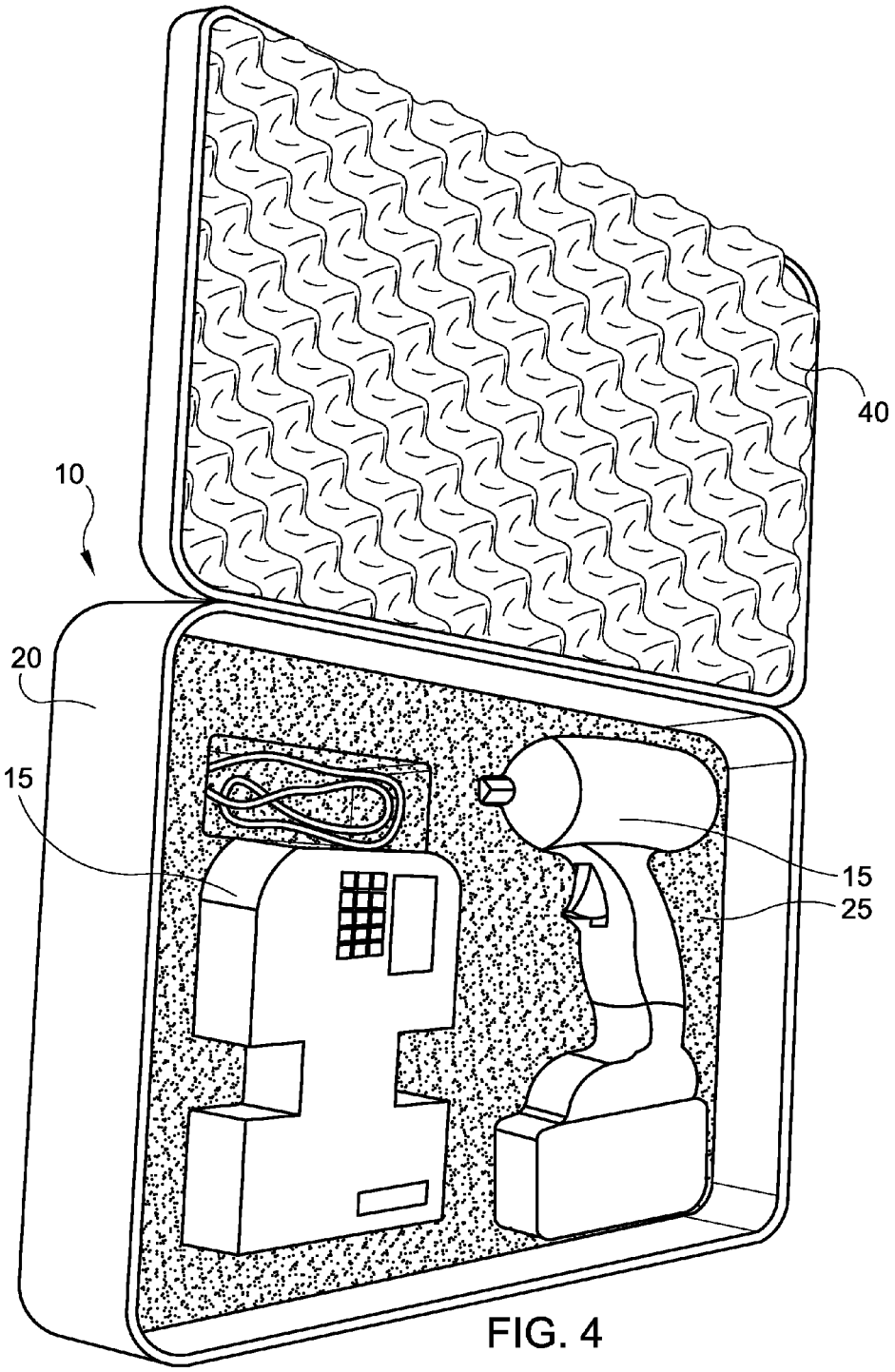
FIG. 4 shows a perspective view of one embodiment of the case of the present invention having items placed therein.
Figure 5:
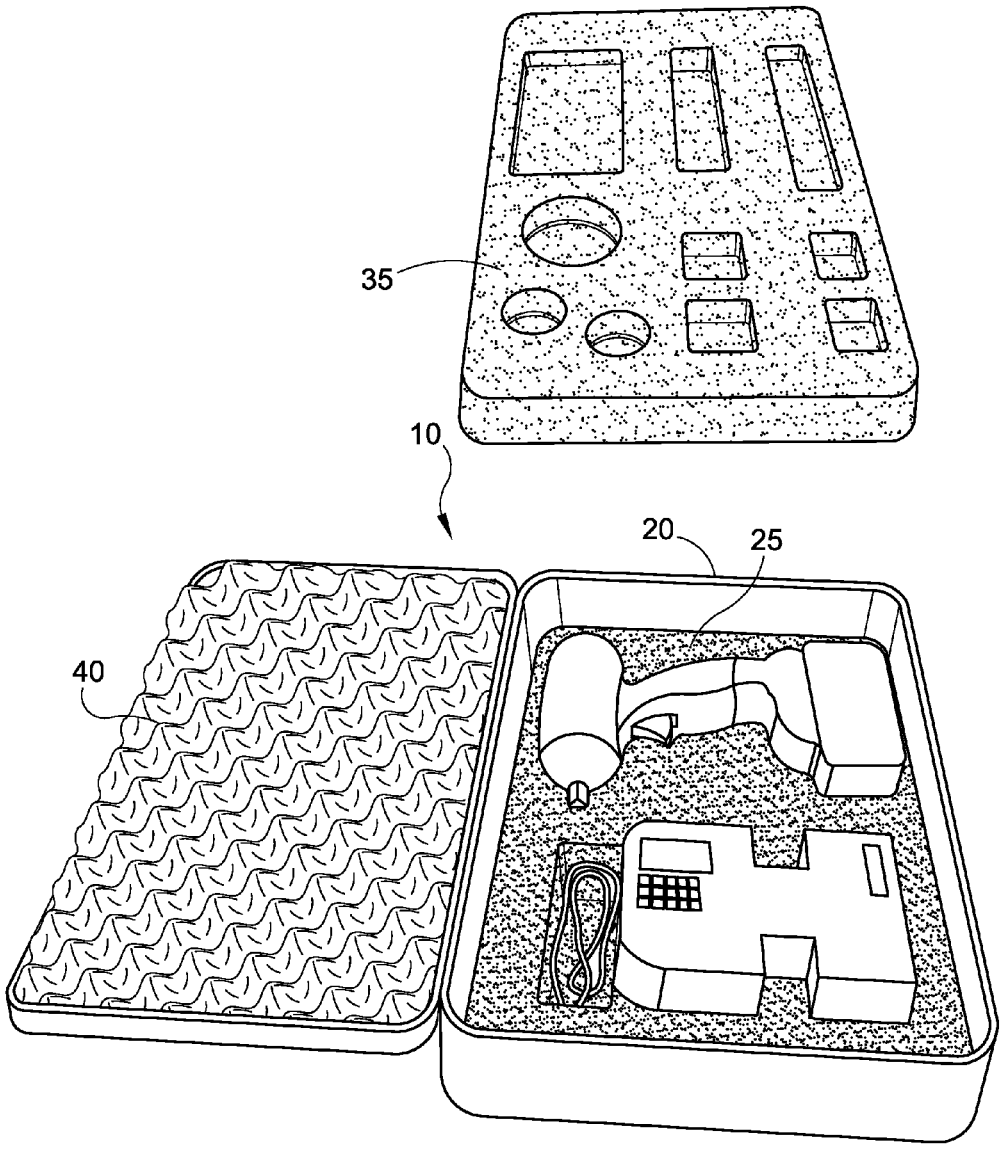
FIG. 5 shows a perspective view of another embodiment of the case of the present invention having a second layer.
Figure 6:
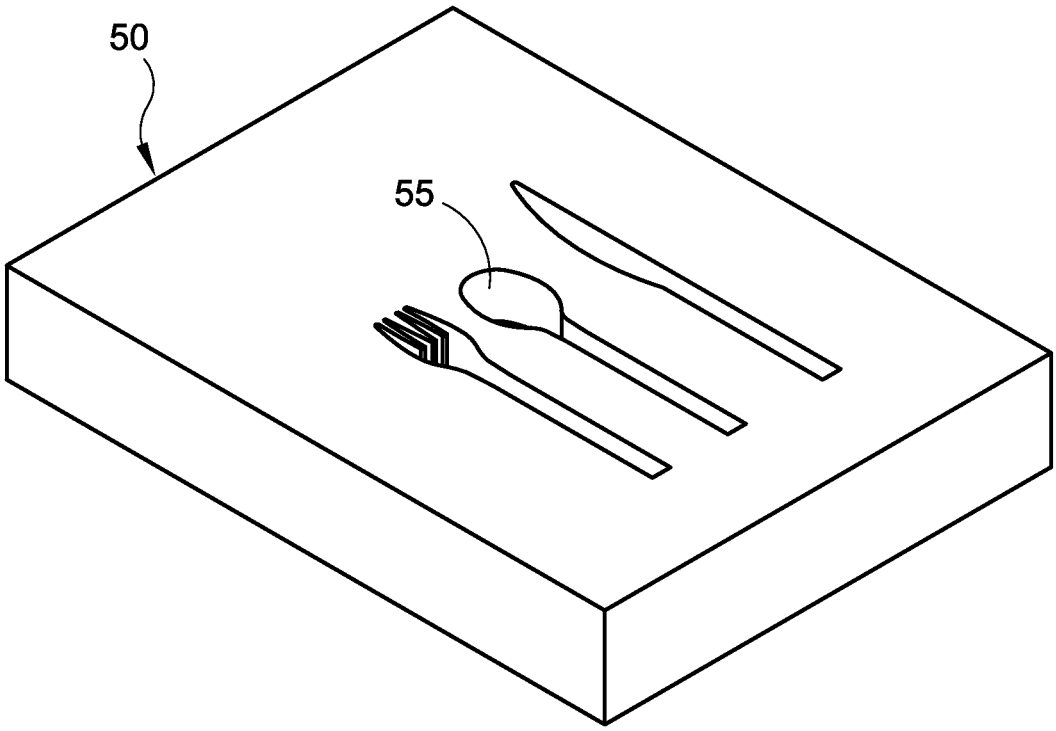
FIG. 6 shows a perspective view of another embodiment of the custom tray of the present invention.

While this invention is susceptible of embodiments in many different forms, there are shown in the drawings and will herein be described in detail, preferred embodiments of the invention with the understanding that the present disclosure is to be considered as an exemplification of the principles of the invention and is not intended to limit the broad aspect of the invention to the embodiments illustrated.

The present invention is a custom impression case 10 for enclosing one or more items 15. The case 10 includes an outer shell 20. The outer shell 20 may take on various configurations. In various embodiments, the outer shell 20 may comprise a hard plastic material or other hard material, or any suitable material for the intended purpose. In certain embodiments, the shell 20 may have two parts, a bottom part and a top part, which are optionally hinged together to allow for opening and closing.

Inside the outer shell 20 is an inner base layer 25 formed of an impression material. By impression material, it is meant any material having the property that it can be compressed in a particular shape, after which it will hold that shape. Various materials are suitable. In certain embodiments, an impression foam is used, such as OASIS DELUXE FLORAL FOAM.

A cavity 30 is formed in the impression material of the inner base layer 25 by compressing the impression material using an object. The object may be the item 15 intended to be enclosed in the case 10, or an object having the same or similar outer shape as the item 15 intended to be enclosed. This, the inner base layer 25 provides a close fit for the placement of the item and will prevent it from moving around significantly within the case 10.

The base layer 25 has a bottom surface which is shaped to fit within the outer shell 20. Optionally, an adhesive can be applied between the outer shell 20 and the base layer 25 to secure the elements together.

In various preferred embodiments, the impression material, such as impression foam, is hardened using a hardening agent. The hardening agent may be a glue such as latex glue, however, any suitable agent is contemplated within the scope of the present invention. One suitable type of glue would be SIMALFA 321 glue. In certain embodiments, the impression foam is dipped or submerged in the glue for a short period of time, removed, and then allowed to dry. Thus, the material is hardened and better resists damage.

In various embodiments, after the impression material is hardened, it is optionally coated with a paint or a stain. Such a coating can help make the surface non-porous, smooth, and aesthetically pleasing. The paint can be applied via brushing, sponge-brushing, spraying, or any other suitable method. In certain embodiments, a truck bed paint such as a DUPLI-COLOR TRUCK BED COATING may be used for this purpose.

In various alternative embodiments, the hardened material may be finished using a process known as flocking. In this process, an adhesive is applied to the hardened material, and a fiber, felt, or felt-like material is applied to the adhesive. In this manner, a cushioned, soft surface may be produced. While this process may be used directly in coating the hardened material, it optionally may be used in addition to the paint or stain coating.

In certain embodiments, the custom case 10 includes a second base layer 35 adapted to fit above the base layer 25. This second base layer 35 can be constructed in the same fashion as the base layer 25. In other words, it can also be a custom fit for items 15 to be additionally enclosed in the case 10. It is preferably composed of an impression foam and formed by compressing a cavity 30 into the foam. Optionally, the hardening process or the painting process, or both, can be utilized on the second base layer 35 as well.

Preferably, a top layer 40 is provided to fit over the base layer 25 or the second base layer 35. This top layer 40 may be composed of any suitable material. In certain embodiments, the top layer 40 may be composed of a foam material. It optionally may have an eggshell shaped configuration.

The present invention also includes a method for making a custom case 10 for enclosing one or more items 15. The method includes the step of providing an outer shell 20 as described above. The inner base layer 25 is provided and is composed of an impression material as described above. The method further includes the step of compressing the impression material using an item 15 or an object shaped like the item 15 to create a cavity 30 having a shape adapted to provide a close fit with the item 15. In certain embodiments, in the event the item 15 to be placed in the cavity 30 is fragile or easily damaged, another object or set of objects having substantially the shape and size of the relevant portion of the item 15 may be used to compress the impression material to create the cavity 30. Furthermore, if an item 15 has a large surface area, because it might be difficult to compress the impression material all at once with the item 15, a set of smaller objects may be used to create the cavity 30 in a way that it will have substantially matching dimensions as the item 15.

In the method, the inner base layer 25 is placed within the outer shell 20. Optionally, the method includes the step of applying a glue such as a latex glue to the impression material after compressing it. This hardens the material to help it stay intact. Optionally, the material is then coated with a paint or stain such as a truck bed paint or other suitable paint or stain. A top foam layer 40 is optionally provided, and a second base layer 35 may optionally be provided.

The present invention encompasses a kit for a custom case 10 which can be provided to a customer for customization. The kit can include the items necessary to customize the case 10, and may include some or all of the following items, or suitable substitutes therefor. An outer shell 20 is provided. An inner base layer 25 as described above is provided. The inner base layer 25 may be placed in the outer shell 20 and separated from it with a thin plastic sheet which can be used to pull it out of the shell 20. The bottom surface of the inner base layer 25 may be hardened or painted or finished ahead of time. A second base layer 35 may be provided. A top layer 40 may be provided. A container or tray adapted to hold a glue or hardening agent such as a latex glue is provided adapted such that the customer can dip or submerge the inner base layer 25 in the glue. Paint may be provided, brushes or sponge brushes may be provided, and latex or vinyl gloves may be provided. A top layer 40 of foam may additionally be provided.

In other various embodiments of the present invention, a custom tray 50 for receiving at least one item is provided. The tray 50 is formed of an impression material, such as impression foam. A cavity 55 is formed within the impression foam by an object which is to be received by the cavity 55, or alternatively, by an object having substantially the same impression-forming shape as the object to be received. Thus, the cavity 55 will form a close fit with the item to be received. A kit may be sold, as described herein, having the materials required to prepare the custom tray 50. It is contemplated within the scope of the invention that the tray 50 might be used for the purpose of inserting it into a case.

In certain embodiments, the tray 50 of the present invention has a top surface and a bottom surface. In some embodiments, the bottom surface, and the tray as a whole, is shaped and adapted to fit within a drawer, cabinet, or on a shelf.

As discussed above with respect to the base layer 25, the tray 50 can be hardened using a hardening agent such as a latex glue. A coating, such as a paint or stain, can be used for aesthetic treatment as well as to create a substantially non-porous surface.

Thus, the user may create a custom tray 50 designed for the specific purposes of that user. For example, a jewelry container, tool container, flatware container, or any other container for specific items can be created and provide a substantially close fit for those items.

While specific embodiments have been illustrated and described, numerous modifications come to mind without significantly departing from the spirit of the invention and the scope of protection is limited by the scope of the accompanying claims.

What is claimed is:

1. A method for making a custom tray for enclosing at least one item, comprising the steps of: forming a rigid outer shell, forming an open cell rigid foam base having a surface that is physically permanently deformable without the addition of any catalyst, pressing an object having the shape desired to be retained in the tray into the base surface permanently forming an impression in the foam base without any catalyst or other process to create a cavity having a shape adapted to provide a close fit with the item, thereafter coating the impressed base surface with a glue to close the cellular surface of the foam base, and placing the coated foam base in the outer shell to form a tray.

2. The method for making a custom tray for enclosing at least one item according to claim 1, further comprising the step of: applying a [latex] glue to said impression material after the step of compressing said impression material in order to harden said impression material.

3. The method for making a custom tray for enclosing at least one item according to claim 2, further comprising the step of: coating said impression material with a paint or stain.

4. The method for making a custom tray for enclosing at least one item according to claim 3, wherein the impression material is an impression foam.

5. The method for making a custom case for enclosing at least one item according to claim 2, further comprising the steps of: coating said impression material with a felt or felt-like material via an adhesive.

6. The method for making a custom tray for enclosing at least one item according to claim 2, further comprising the step of: covering at least a portion of said impression material with a soft material.

7. The method for making a custom tray for enclosing at least one item according to claim 1, further comprising the step of: providing an outer shell, placing said inner base layer within said outer shell.

8. The method for making a custom tray for enclosing at least one item according to claim 1, wherein said cavity is adapted to provide a close fit with a jewelry item.

9. The method for making a custom tray for enclosing at least one item according to claim 1, wherein said cavity is adapted to provide a close fit with a tool item.

10. The method for making a custom tray for enclosing at least one item according to claim 1, wherein said cavity is adapted to provide a close fit with a utensil item.

* * * * *